United States Patent [19]

Dunbar

[11] Patent Number: 4,683,933

[45] Date of Patent: Aug. 4, 1987

[54] MOTOR DRIVEN SHADE LOWERING AND RAISING MECHANISM FOR ATRIUM WALLS

[75] Inventor: Donald D. Dunbar, Columbus, Ohio

[73] Assignee: Inside Outfitters, Inc., Columbus, Ohio

[21] Appl. No.: 631,424

[22] Filed: Jul. 16, 1984

[51] Int. Cl.[4] ..... E06B 9/204; E06B 9/322

[52] U.S. Cl. ..... 160/273 R; 160/84 R

[58] Field of Search ..... 160/7, 84 R, 85, 86, 160/32, 35, 36, 253, 254, 272, 273 R, 345, 346; 47/17

[56] References Cited

U.S. PATENT DOCUMENTS

| | | | |
|---|---|---|---|
| 106,211 | 8/1870 | Root | 160/254 |
| 2,031,157 | 2/1936 | Gilson | 160/120 |
| 3,016,951 | 1/1962 | Greene | 160/346 |
| 3,151,666 | 10/1964 | Ford | 160/346 |
| 3,315,727 | 4/1967 | Clark | 160/84 R |
| 3,481,073 | 12/1969 | Yoshida et al. | 160/84 R X |
| 3,510,996 | 5/1970 | Popil | 160/35 |
| 3,613,765 | 10/1971 | Sivin | 160/7 |
| 3,672,425 | 6/1972 | Schulze-Robbecke | 160/345 |
| 4,557,310 | 12/1985 | Castellaw | 160/84 R |
| 4,596,093 | 6/1986 | Esposito | 47/17 |

FOREIGN PATENT DOCUMENTS

| | | | |
|---|---|---|---|
| 532020 | 1/1941 | United Kingdom | 160/348 |
| 533128 | 2/1941 | United Kingdom | 160/84 R |
| 1113577 | 5/1966 | United Kingdom | 47/17 |

*Primary Examiner*—Ramon S. Britts
*Assistant Examiner*—Cherney S. Lieberman
*Attorney, Agent, or Firm*—John L. Gray

[57] ABSTRACT

A motor driven device for raising and lowering shades on glass-enclosed atrium walls, including a self-leveling feature which corrects for uneven shades and permits shades of different lengths to be operated from the same motor and shaft.

4 Claims, 5 Drawing Figures

MOTOR DRIVEN SHADE LOWERING AND RAISING MECHANISM FOR ATRIUM WALLS

BACKGROUND OF THE INVENTION

Glass-enclosed atrium or greenhouse structures are being used with greater frequency in restaurants and commercial buildings as well as homes. While these structures have many aesthetic advantages and are pleasing architecturally, in direct sunlight they become practically uninhabitable with severe discomfort on the part of the occupants. Consequently, it is necessary to provide some sort of a shading device which may be readily raised or lowered. Because these structures typically involve a vertical wall of glass which, at its topmost portion, is curved to a 45° angle with the upper portion extending at such an angle until it joins the conventional portion of the structure, ordinary shades or blinds will not function because they would hang in an unattractive, ineffective fashion because of the overhanging curved portion of the atrium.

Therefore, it is necessary to provide tracks on which the shades can be supported and, as a consequence, these atriums or greenhouses are usually constructed in sections with tracks spaced three or four feet apart. The shades are thus supported on transversely extending rods that ride in said tracks and the shades are usually permitted to descend by gravity and may be raised by hand or by means of a motorized device. In any case, the shades occasionally will stick in one or the other tracks so that the shade will be askew and cause an unattractive appearance. This can occur either when the shade is raised or when it is lowered.

Power driven devices of the prior art are illustrated by U.S. Pat. No. 4,062,146, Grossman, et al., and U.S. Pat. No. 4,062,519, Jacobs.

SUMARY OF THE INVENTION

The subject invention is a motor driven device for raising or lowering shades on a glass-enclosed atrium wall which includes a self-leveling feature so that if a shade should get hung up at the bend portion of the atrium wall where the vertical portion joins the sloping portion or elsewhere, the device will self-adjust so that the shades will ultimately hang level in the raised or lowered position. The subject invention is susceptible of operating a multiple number of glass-enclosed atrium wall sections, including sections adjacent to corners of the atrium where there is a narrower portion that does not extend full width of an atrium wall section at the upper portion, and hence utilizes a shorter shade. It also may be used to operate shades in atrium wall sections that are at an angle to the other atrium wall sections.

It is therefore an object of this invention to provide a device to raise and lower shades on an atrium or greenhouse wall.

It is a further object of this invention to provide such a device which will permit the shades to be self-leveling in their open or closed position.

It is a still further object of this invention to provide such a device which may be operated in portions of said atrium wall where the upper atrium wall portion is not as wide as the lower atrium wall portion.

It is a still further object of this invention to provide such a shade raising and lowering device that will operate shades in sections of the atrium wall that are at an angle to other sections of the atrium wall.

Additional objects and advantages of the present invention will become more readily apparent to those skilled in the art when the following general statements and descriptions are read in the light of the appended drawings.

DETAILED DESCRIPTION OF THE INVENTION

Figure 1:
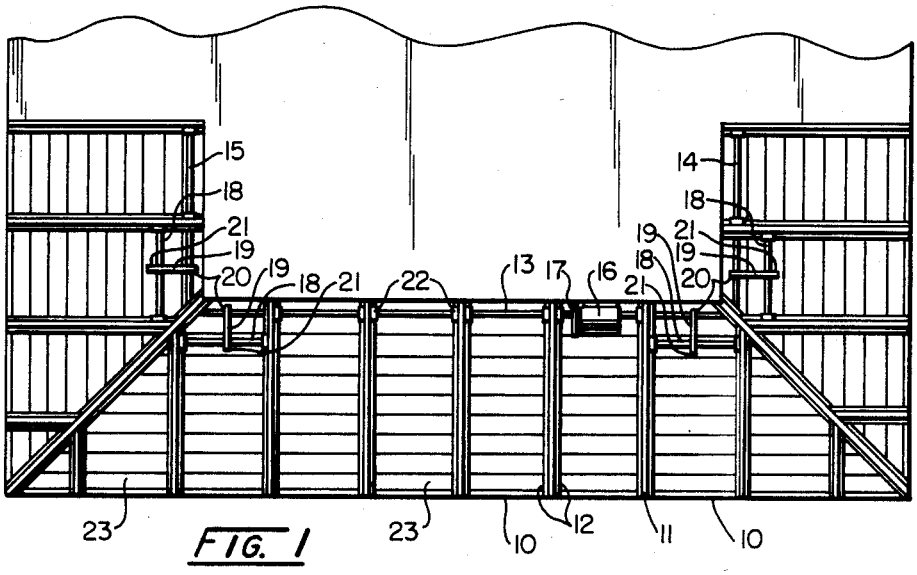
FIG. 1 is a plan view of a typical, glass-enclosed U-shaped atrium of greenhouse showing applicant's invention positioned at the upper portion of the atrium walls.
Figure 2:
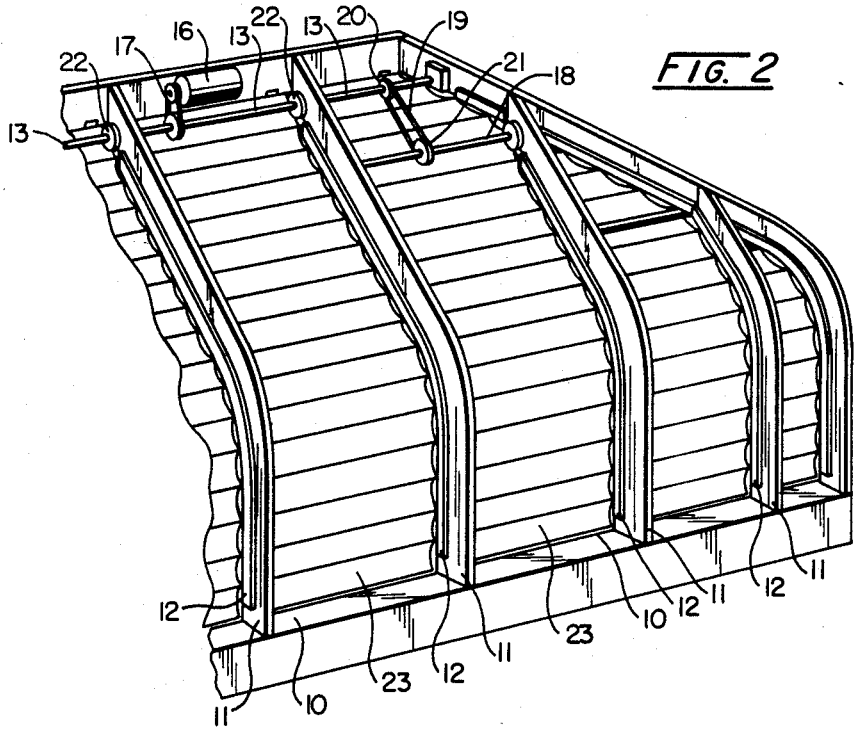
FIG. 2 is a perspective view of a corner section of the atrium walls showing applicant's invention as applied to a portion of the atrium wall which is narrower at the upper portion than it is at the lower portion.

Referring now more particularly to FIG. 1, the atrium wall is shown having sections 10—10 separated by mullions 11—11 provided with tracks 12—12 on either side thereof. Shaft 13 extends across all of the atrium wall sections and by means of suitable gearing (not shown) is attached to shafts 14—14 and 15—15 in portions of the atrium walls that are at an angle to the other portion of the atrium walls. This shaft is driven by motor 16 through a suitable sprocket and pulley drive 17. In the case of the four portions of the atrium walls that are slightly narrower at the upper end thereof, separate drive shafts 18—18 are provided, which are driven by belts 19—19 cooperating with pulleys 20—20 and 21—21. Each of the portions of the shafts 13, 14 and 15 in an atrium wall section are provided with pulleys 22—22 at each end thereof in line with tracks 12—12. These pulleys drive the associated cords that operate to raise or lower the shades 23—23. This may be seen more readily by referring to FIG. 2.

Figure 3:
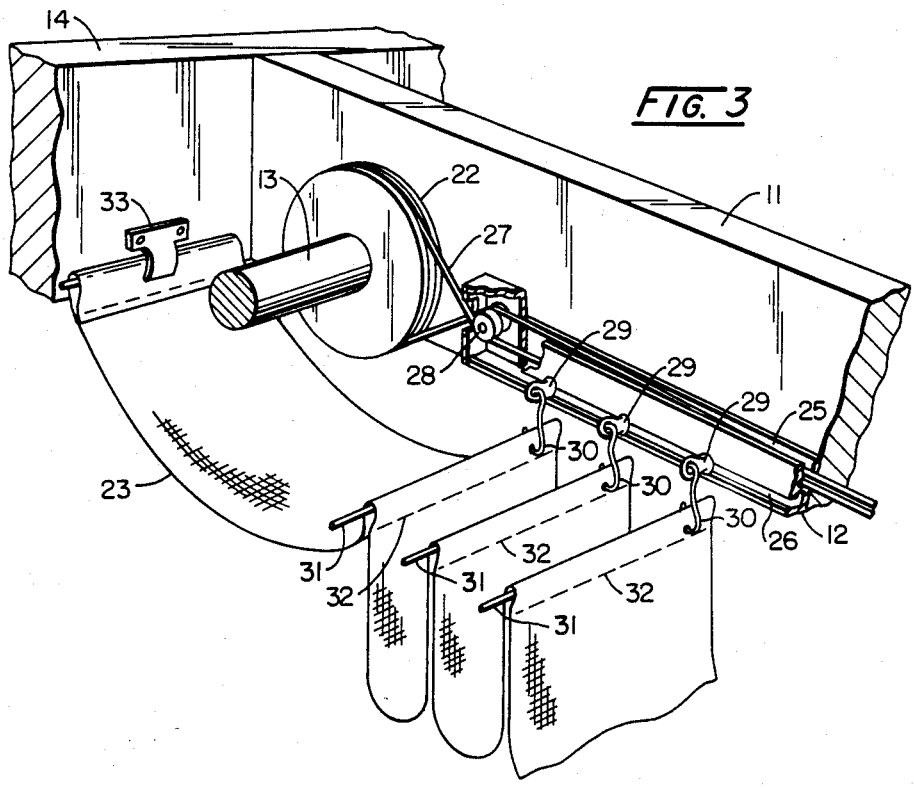
FIG. 3 is a detailed perspective view of the drive portion of applicant's invention.

Referring now more particularly to FIG. 3, the mullions 11—11 are connected at the upper portion to horizontally extending member 24. Compartmentalized track Track 12 is provided with an upstanding U-shaped portion 25 in cross section and a lower U-shaped portion 26 in cross section at right angles thereto, connected together by a common wall **26*a*, forming the base of portion 25 and a side portion of 26. Drive cord 27 is frictionally engaged with drive pulley 22 and passes over idler 28 before extending down into U-shaped portion 25 of track 12. The lower U-shaped portion 26 of track 12 is used to guide the supports 29—29, each of which is provided with a hook 30—30 which supports rods 31—31 which are placed in sewn pockets 32—32 of shade 23. Shade 23 is held to horizontal member 24 by means of clip 33**.

Figure 4:
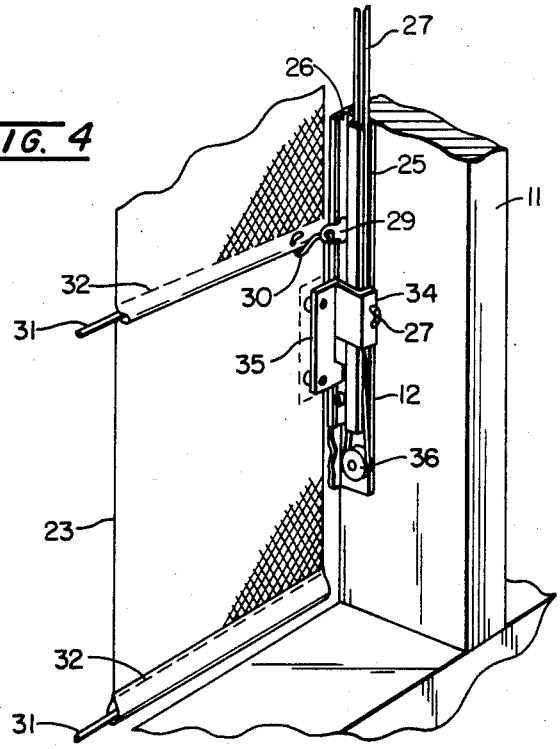
FIG. 4 is a detailed view of the portion of applicant's invention attached to the lower shade member.
Figure 5:
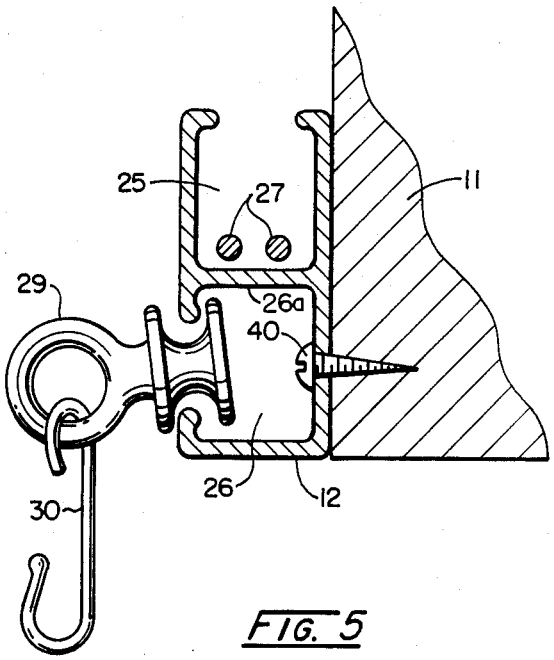
FIG. 5 is a cross-sectional view of the compartmentalized track comprising a portion of applicant's invention.

Referring now more particularly to FIG. 4, the lower end of shade 23 is attached to drive member 34 which is securely attached to the lower portion of the shade 23 at 35 and also positively engages the cord 27 which is threaded around pulley 36, cord 27 being a continuous single loop under slight tension.

In operation, motor 16 is turned on in the direction desired either to raise or lower the shade. Preferably a switch is used which must be manually held shut until the shade reaches the desired open or closed position. Rotation of the motor causes rotation of the shaft 13, pulley 22, and upward or downward movement of cord 27, depending upon the desired direction chosen. The configuration of the atrium is such that it is very common for the members 29—29 to move at different speeds than the members opposite them at the other end of rods 31—31, especially in the portion of the atrium where the vertical wall becomes an upward sloping wall. If this occurs, it is only necessary to continue to apply power to the motor and that side of the shade which reaches the upper or the lower position ahead of the other portion, will stay in that position because of the friction drive of pulley 22 and cord 27, while the opposite pulley will continue to drive the shade, thus leveling the shade in the upper or lower position.

Likewise, operation of the motor will cause shafts 14—14 and 15—15 to rotate causing the shades associated therewith to be raised or lowered and because of the additional pulleys 20 and 21, and belt 19, shaft 18 will also rotate raising that portion of the shade in that section of the atrium wall to its highest point. Again, because of the friction drive of the pulleys and the cords, even though that portion of the shade will reach its final position when being raised prior to the other shade portions reaching their higher position, the shade will be held at its upper position until the other shades reach their upper position. The reverse is true in lowering the shades. The shades associated with pulley 21—21 will naturally reach their lowest position prior to the other shades reaching their lower position but, again, because of the friction drive the shades will merely remain in the closed position until the other shades reach this closed position.

Thus, it will be seen that by means of the combination of a positive lowering and raising of the shade coupled with a friction drive, variations in friction causing unevenness of the shades when being raised or lowered will automatically be compensated for as will the fact that some shades have a greater distance to travel than other shades.

While this invention has been described in its preferred embodiment, it is to be appreciated that variations therefrom may be made without departing from the true scope and spirit of the invention.

What is claimed is:

1. A device for raising and lowering a plurality of shades on a wall having a vertical portion connected to a concave portion which in turn is connected to a portion approaching the horizontal, said wall being provided with a plurality of windows extending from the vertical portion through the concave portion and into the portions approaching the horizontal, said windows being separated by mullions extending throughout the length of said windows, at least a portion of each of said shades being positioned adjacent both said concave portion of said wall and said portion of said wall approaching the horizontal, said device comprising:

a plurality of compartmentalized parallel tracks attached to said wall on said contour of said wall, each mullion having a track on each side thereof so as to provide a pair of tracks for each window, said compartmentalized track having a U-shaped cord guiding portion, the opening of which extends toward said windows and a U-shaped shade supporting portion, the opening of which faces the edge of said shade, and a common wall forming the base of said cord guiding portion and a side of said shade supporting portion, a plurality of shade supports positioned in said shade supporting portion of each of said tracks, a shade positioned between each pair of tracks and connected to said shade supports, said cord guiding portion of each of said tracks being provided with means to prevent said cords from touching said shade and from sagging when said cords are in the concave position or in the position approaching the horizontal of said cord guiding portion of each of said tracks, a drive pulley positioned at the upper end of each of said tracks, a driven pulley positioned at the lower end of each of said tracks, an endless cord engaging both of said pairs of driving and driven pulleys and positioned in the associated cord guiding portion of each of said tracks, means for fixedly securing said cord to the lower portion of the shade to be raised or lowered by said device, wherein said means comprises a base portion permanently secured to a lower portion of the shade and an extension to which the cords are secured and which rides in the cord guiding portion of said track wherein said shade may be raised or lowered by movement of said cords, and motor means for rotating said drive pulleys in either direction.

2. The device of claim 1 wherein said drive pulleys are driven by a common shaft.

3. The device of claim 2 wherein said shaft is provided with a pulley engaging a belt, said belt in turn engaging a pulley on a second shaft parallel to said first shaft.

4. The device of claim 1 wherein said shade is provided with spaced horizontally extending rods and a plurality of sliding members engaging the lower shade supporting portion of said tracks adapted to be attached to said rods.

* * * * *